US008550797B2

(12) United States Patent
Lee et al.

(10) Patent No.: US 8,550,797 B2
(45) Date of Patent: Oct. 8, 2013

(54) SCROLL COMPRESSOR WITH IMPROVED BACK PRESSURE FORCE CONTROL FUNCTION

(75) Inventors: Geon Ho Lee, Seongnam-si (KR); In Hwe Koo, Seongnam-si (KR)

(73) Assignees: Doowon Technical College (KR); Doowon Electronic Co., Ltd. (KR)

( * ) Notice: Subject to any disclaimer, the term of this patent is extended or adjusted under 35 U.S.C. 154(b) by 242 days.

(21) Appl. No.: 13/057,751

(22) PCT Filed: Jul. 31, 2009

(86) PCT No.: PCT/KR2009/004285

§ 371 (c)(1),
(2), (4) Date: Apr. 25, 2011

(87) PCT Pub. No.: WO2010/016689

PCT Pub. Date: Feb. 11, 2010

(65) Prior Publication Data

US 2011/0194964 A1 Aug. 11, 2011

(30) Foreign Application Priority Data

Aug. 5, 2008 (KR) ..... 10-2008-0076567

(51) Int. Cl.
*F03C 2/00* (2006.01)
*F03C 4/00* (2006.01)
*F04C 18/00* (2006.01)

(52) U.S. Cl.
USPC ..... 418/55.5; 418/55.1; 418/57; 418/104; 418/179

(58) Field of Classification Search
USPC ..... 418/178, 179, 55.1–55.6, 57, 270, 418/104
See application file for complete search history.

(56) References Cited

U.S. PATENT DOCUMENTS 4,995,789 A * 2/1991 Fujio ..... 417/360
5,435,706 A * 7/1995 Matsumoto et al. ..... 418/55.3

(Continued)

FOREIGN PATENT DOCUMENTS

CN 1373299 10/2002
CN 1598316 3/2005

(Continued)

OTHER PUBLICATIONS

International Search Report dated Mar. 17, 2010 in International Application No. PCT/KR2009/004285 (2 pages).

(Continued)

*Primary Examiner* — Theresa Trieu
(74) *Attorney, Agent, or Firm* — Knobbe Martens Olson & Bear, LLP

(57) ABSTRACT

A scroll compressor that includes: a housing, a drive unit configured to generate a rotating force; and a scroll compression unit having a fixed scroll having a spiral scroll wrap for compressing a suctioned fluid and fixed irrespective of a rotation of a drive shaft of the drive unit and a swivel scroll swiveled according to rotation of the drive shaft and having a spiral scroll wrap, comprises: a main frame disposed within the housing to support a rear surface of the swivel scroll and having a back pressure chamber in an interior thereof; a thrust plate disposed between the swivel scroll and the main frame; and a sealing member inserted between the swivel scroll and the main frame. The sealing member includes a first sealing member inserted between the swivel scroll and the thrust plate, and a second sealing member inserted between the thrust plate and the main frame.

6 Claims, 5 Drawing Sheets

(56) References Cited

U.S. PATENT DOCUMENTS

| | | | | |
|---|---|---|---|---|
| 6,561,776 | B2 * | 5/2003 | Morozumi | 418/55.5 |
| 2002/0119063 | A1 | 8/2002 | Morozumi | |
| 2007/0292294 | A1 * | 12/2007 | Fujita et al. | 418/55.5 |

FOREIGN PATENT DOCUMENTS

| | | | | | |
|---|---|---|---|---|---|
| JP | 02009972 | A | * | 1/1990 | 418/55.2 |
| JP | 05-149275 | A | | 6/1993 | |
| JP | 09126161 | A | * | 5/1997 | F04C 18/02 |
| JP | 2002-257056 | A | | 9/2002 | |
| JP | 2005-325842 | A | | 11/2005 | |
| KR | 100414079 | B1 | | 12/2003 | |
| KR | 10-0414079 | B1 | | 4/2004 | |

OTHER PUBLICATIONS

Korean Office Action dated Aug. 31, 2011 of corresponding Korean Patent Application No. 10-2008-0076567—3 pages.

* cited by examiner

PRIOR ART

PRIOR ART

SCROLL COMPRESSOR WITH IMPROVED BACK PRESSURE FORCE CONTROL FUNCTION

TECHNICAL FIELD

The present invention relates to a scroll compressor, and more particularly to a scroll compressor with an improved back pressure force control function that firmly seals a back pressure chamber while controlling a back pressure force, enhancing efficiency.

BACKGROUND ART

In general, a scroll compressor includes a scroll wrap, and performs a compression operation through a relative movement between a fixed scroll fixed irrespective of a rotation of a drive shaft and a swivel scroll configured to swivel according to a rotation of the drive shaft. There are circulated many type of scroll compressors in the market.

An example of such a scroll compressor is disclosed in Korean Laid-Open Patent No. 1998-0050613, and will be briefly described with reference to FIG. 1A and FIG. 1B.

As shown in FIG. 1A and FIG. 1B, according to the conventional scroll compressor, upper and lower frames 2 and 3 are installed inside a sealed vessel 1 at upper and lower portions of the sealed vessel 1, a stator 4 is fixed and installed between the upper and lower frames 2 and 3, a rotor 5 is inserted into and installed in an inner periphery of the stator 4, a drive shaft 6 is press-fitted into a central portion of the stator 5 such that it passes through a central portion of the upper frame 2, and a swivel scroll 7 having an involute wrap 7*a* is eccentrically coupled to the drive shaft 6 and is positioned on an upper end surface of the upper frame 2.

A fixed scroll 8 engaged with the wrap of the swivel scroll 7 to from a compression chamber is positioned on the upper side of the swivel scroll 7 and engaged with the periphery of the upper frame 2, and an Oldham ring 9 serving as a rotation preventing mechanism is coupled between the upper frame 2 and the swivel scroll 7.

The reference numeral 10 represents a discharge cover, 11, a check valve housing, 12, a suction pipe, and 13, a discharge pipe.

In the conventional scroll compressor, the rotor 5 is rotated inside the stator 4 when electric power is applied to it to rotate the drive shaft 6, in which case the drive shaft eccentrically rotates the swivel scroll 7 by an eccentric distance. Then, the swivel scroll 7 is swiveled by the Oldham ring 9 about the center of the shaft thereof at a distance separated by a swivel radius.

A compression chamber (pocket) is formed between the wraps 7*a* and 8*a* of the swivel scroll 7 and the fixed scroll 8 by the swivel movement of the swivel scroll 7 such that it is moved to the center thereof by the continuous swivel movement, whereby its volume is reduced and the suctioned refrigerant gas is further compressed.

Here, the rear surface of the fixed scroll 8 and the bottom surface of the discharge cover 10 are recessed and protruded once respectively such that a back pressure chamber 14 is formed on the corresponding surface of the recess and protrusion, a back pressure hole 14*a* communicated with the compression chamber of the fixed scroll 8 is formed on one side of the back pressure chamber 14, and sealing members (not shown) are interposed at opposite sides of the back pressure chamber 14.

According to the conventional scroll compressor, a refrigerant gas introduced through a suction opening (not shown) formed in the fixed scroll 8 is suctioned at opposite ends of the circumference of the scroll as the swivel scroll 7 swivels and is confined in two crescent moon-shaped pockets (compressions) having the same volume. The volume of the pockets is continuously reduced to compress the refrigerant gas in the process of moving the center thereof.

In the conventional scroll compressor, the back pressure hole 14*a* communicated with the back pressure chamber 14 is formed at a predetermined position of the fixed scroll 8, and a refrigerant gas of an intermediate pressure enters the back pressure chamber 14 through the back pressure hole 14*a* such that the pressure of the refrigerant gas attaches the fixed scroll toward the swivel scroll 7, making it possible to prevent leakage of the refrigerant gas.

However, since the conventional scroll compressor has a structure adapted to axially move the fixed scroll with respect to the swivel scroll 7, its structure is unstable and vibrations are severe.

Moreover, when the swivel scroll 7 is pushed downward by the high pressure of the pocket, it contacts an upper end surface of the upper frame 2. Accordingly, excessive friction is caused between the swivel scroll 7 and the upper frame 2, deteriorating the efficiency of the compressor and causing damage.

DISCLOSURE

Technical Problem

Therefore, according to the present invention, there is provided a scroll compressor with an improved back pressure force control function that prevent wear of a frictional portion between a swivel scroll and a main frame while minimizing the mass of the compressor by adding a thrust plate of high hardness to the frictional portion and prevents lowering of an efficiency of the compressor and damage to the compressor.

There is also provided a scroll compressor in which a back pressure force can be easily regulated by regulating the area of the sealing member.

There is also provided a scroll compressor that allows a space for mounting the sealing member to be easily secured to sufficiently maintain the sealing effect of a back pressure chamber and enhances the durability of the sealing member.

Technical Solution

In order to achieve the above-mentioned objects, there is provided A scroll compressor with an improved back pressure force control function that includes: a housing, a drive unit configured to generate a rotating force; and a scroll compression unit having a fixed scroll constituted by a spiral scroll wrap for compressing a suctioned fluid and fixed irrespective of a rotation of a drive shaft of the drive unit and a swivel scroll swiveled according to rotation of the drive shaft and having a spiral scroll wrap, the scroll compressor comprising: a main frame disposed within the housing to support a rear surface of the swivel scroll and having a back pressure chamber in an interior thereof; a thrust plate disposed between the swivel scroll and the main frame; and a sealing member inserted between the swivel scroll and the main frame, wherein the sealing member includes a first sealing member inserted between the swivel scroll and the thrust plate, and a second sealing member inserted between the thrust plate and the main frame.

Preferably, the swivel scroll and the main frame are made of aluminum, and the thrust plate is made of a steel-based metal.

Preferably, the thrust plate is thermally treated or surface-treated.

Preferably, a receiving recess into which the thrust plate is inserted is formed in the main frame.

Preferably, an outer diameter of the thrust plate is larger than a swivel diameter of the swivel scroll.

MODE FOR INVENTION

Hereinafter, an exemplary embodiment of the present invention will be described in detail with reference to the accompanying drawings.

Figure 1A:
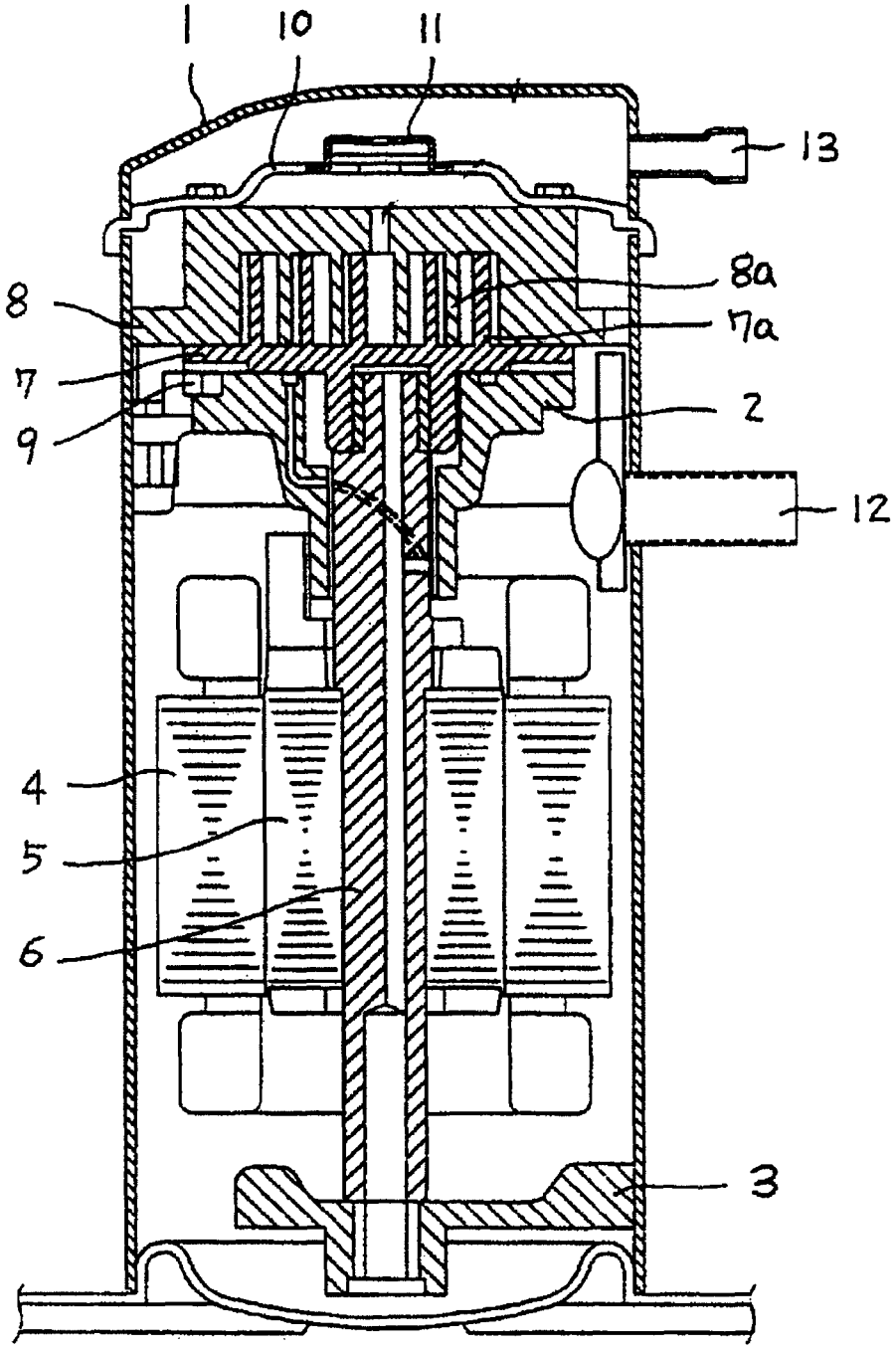
FIG. 1A is a longitudinal sectional view illustrating an example of a conventional scroll compressor with a back pressure force control function.
Figure 1B:
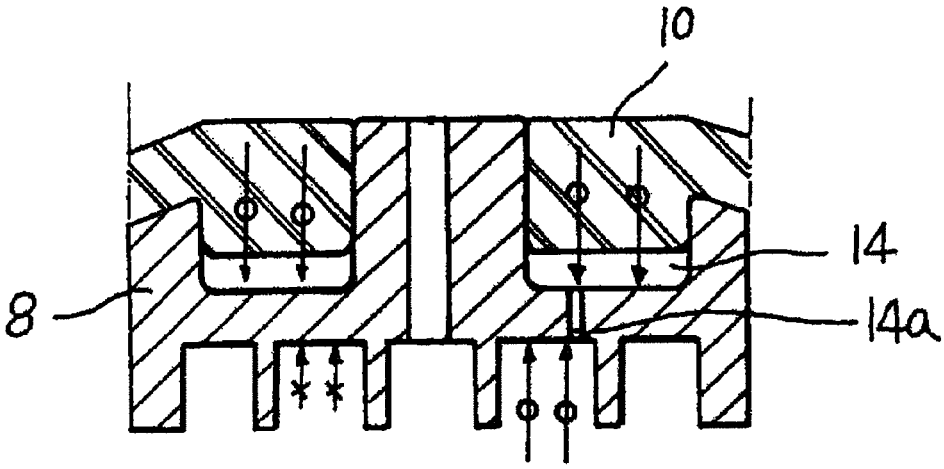
FIG. 1B is a top view illustrating a back pressure structure of FIG. 1A.
Figure 2:
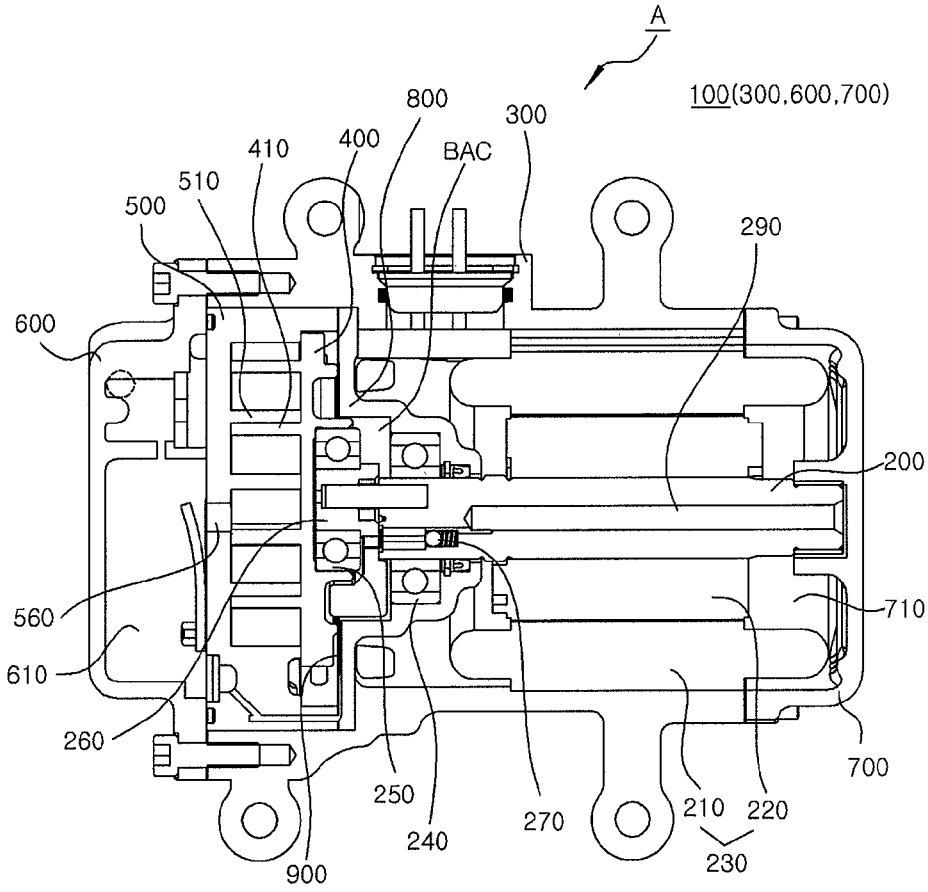
FIG. 2 is a longitudinal sectional view illustrating a scroll compressor according to an embodiment of the present invention.
Figure 3:
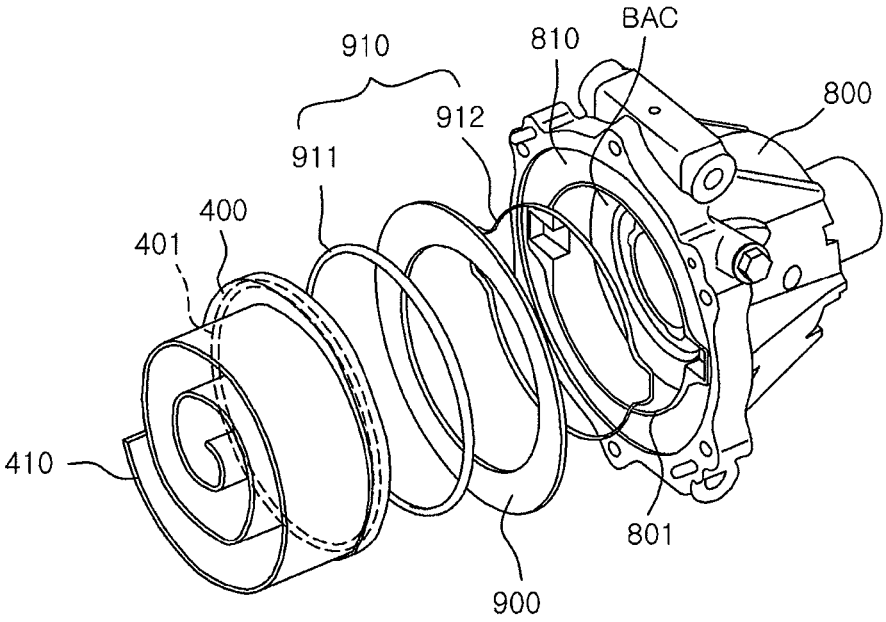
FIG. 3 is a perspective view illustrating a back pressure structure of the scroll compressor according to the embodiment of the present invention.
Figure 4:
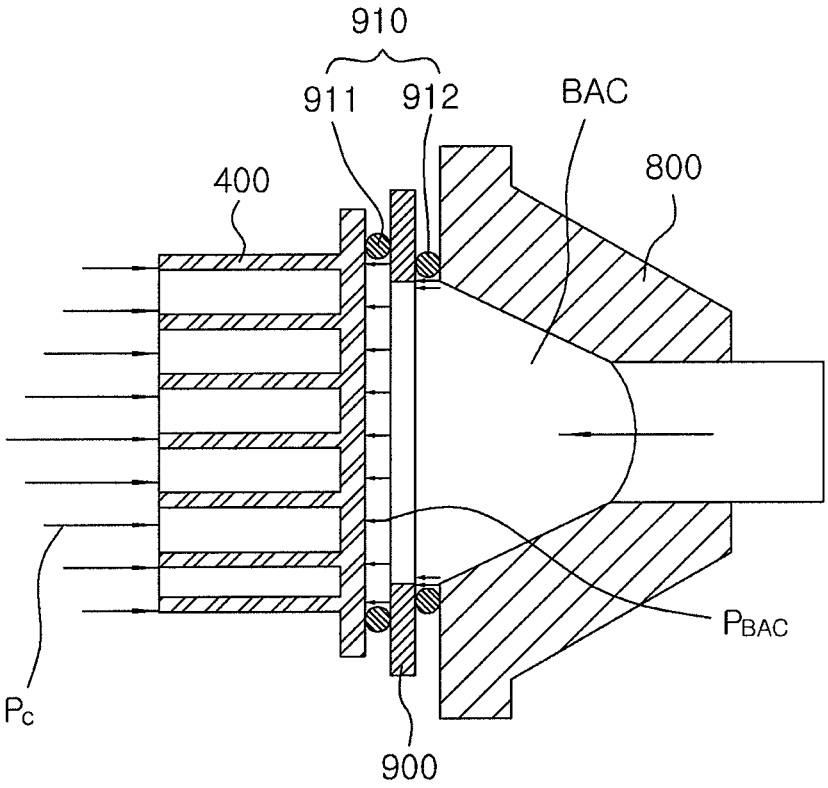
FIG. 4 is a longitudinal sectional view representing a back pressure of the scroll compressor according to the embodiment of the present invention.

FIG. 2 is a longitudinal sectional view illustrating a scroll compressor according to an embodiment of the present invention. FIG. 3 is a perspective view illustrating a back pressure structure of the scroll compressor according to the embodiment of the present invention. FIG. 4 is a longitudinal sectional view representing a back pressure of the scroll compressor according to the embodiment of the present invention.

As shown in FIGS. 2 and 3, the scroll compressor A according to the present invention includes a housing 100, a drive unit configured to generate a rotating force, a drive shaft 200 driven by the drive unit, a scroll compression unit including a fixed scroll 500 having a scroll wrap 510 to compress a suctioned fluid and fixed irrespective of rotation of the drive shaft 200, and a swivel scroll 400 configured to swivel as the drive shaft 200 rotates and having a spiral scroll wrap 410.

Although the housing 100 includes three housing components, i.e. a front housing 600, a main housing 300, and a rear housing 700, it may be divided into two components.

Here, a discharge pipe (not shown) and a discharge chamber 610 are formed in the front housing 600 and a passage through which a refrigerant passes is formed at an intermediate portion of the housing 100. A suction pipe (not shown) and a suction chamber 710 are formed at rear portions of the housing 100.

However, the suction pipe, the suction chamber, the discharge pipe, and the discharge chamber may not be formed as described above, and may be formed at arbitrary positions of the housing.

A main frame 800 for supporting the drive shaft 200 is separately provided in the housing 100 and a back pressure chamber BAC is formed in the interior thereof.

The drive unit includes a drive motor 230 having a stator 210 and a rotor 220 located inside the stator 210, and a drive shaft 200 inserted into a central portion of the drive motor 230 to be rotated.

A main bearing 240 and a sub-bearing 250 are installed in front of the drive shaft 200 rotated and driven by the drive motor 230, and the sub-bearing 250 supports a circumferential portion of an eccentric operation unit 260 eccentrically installed with respect to the drive shaft 200.

Moreover, a return passage 290 extends along a lengthwise direction of the drive shaft 200 in the interior of the drive shaft 200 such that oil returns from the discharge chamber 610 of the front housing 600.

In particular, a control valve 270 is installed in the drive shaft returning passage 290. Thus, when the pressure of the back pressure chamber BAC is high, the control valve 270 is opened to discharge the oil.

The scroll compression unit includes a fixed scroll 500 fixed to the front housing 600 and having a scroll wrap 510, and a swivel scroll 400 coupled to the fixed scroll 500 and having a spiral scroll wrap 410.

The eccentric operation unit 260 installed in the drive shaft 200 is connected to the swivel scroll 400 by means of the sub-bearing 250.

Accordingly, as the drive shaft 200 is rotated, the eccentric operation unit 260 is eccentrically rotated with respect to the drive shaft 200, whereby the swivel scroll 400 installed in the eccentric operation unit 260 by means of the sub-bearing 250 is swiveled with respect to the fixed scroll 500.

As mentioned above, a pocket is formed between the scroll wraps 410 and 510 as the swivel scroll 400 swivels, in which case the volume of the pocket is continuously changed to compress the refrigerant.

A discharge port 560 for exhausting the compressed refrigerant to the discharge chamber 610 of the front housing 600 is formed at a central portion of the fixed scroll 500.

Meanwhile, a high pressure is generated in the pocket by the swivel of the swivel scroll 400, and a force is applied to the swivel scroll 400 in a direction far away from the fixed scroll 500.

In this case, the scroll wraps 410 and 610 are widened, lowering compression efficiency. In order to prevent this, some of the refrigerant discharged to the discharge port 560 is guided to the back pressure chamber BAC of the main frame 800 along the internal passage of the housing 100 to apply a pressure to the rear surface of the swivel scroll 400. The circulation structure of the refrigerant is well known in the art, so a detailed description thereof will be omitted.

Moreover, when a high pressure is applied to the back pressure chamber BAC, the swivel scroll 400 and the fixed scroll 500 are attached to each other, lowering both mobility and compression efficiency. Thus, the back pressure force applied to the swivel scroll 400 is preferably controlled properly, and a detailed description thereof will be described later.

Hereinafter, the back pressure structure of the present invention will be described in detail.

As shown in FIGS. 2 and 3, the back pressure structure includes a main frame 800 configured to support the rear surface of the swivel scroll 400 and having a back pressure chamber BAC in the interior thereof, a thrust plate 900 disposed between the swivel scroll 400 and the main frame 800, and a sealing member 910 inserted between the swivel scroll 400 and the main frame 800.

First, the thrust plate 900 has a sufficient strength to support the swivel of the swivel scroll 400.

The swivel scroll 400 and the main frame 800 is made of aluminum, and may be made of a wear-resistant steel-based metal such as steel and cast iron to prevent wear caused by the swivel of the swivel scroll 400.

Moreover, the thrust plate 900 made of steel is thermally treated (e.g. annealing, carburnizing, treatment by high-frequency waves, hardening by flares, and nitridation) and surface-treated (e.g. sand blasting, air blasting, short blasting, coating, and plating) to improve mechanical performance.

The thrust plate 900 surface-contacts the swivel scroll 400, and a lubrication coating (Teflon, vanadium, antimony), preventing generation of scratches.

A receiving recess 810 into which the thrust plate 900 is inserted is formed in the main frame 800 to prevent movement and rotation of the thrust plate 810, but movement and rotation of the thrust plate 900 can be prevented by a pin, a key, or a protrusion as well as the receiving recess 810.

Moreover, the sealing member 910 includes a first sealing member 911 inserted between the swivel scroll 400 and the thrust plate 900, and a second sealing member 912 inserted between the thrust plate 900 and the main frame 800.

Then, the first sealing member 911 is an O-ring, and a first fixing recess 401 into which the first sealing member 911 is inserted to prevent separation is formed in the swivel scroll 400 and a second fixing recess 801 into which the second sealing member 912 is inserted to prevent separation is formed in the main frame 800.

Accordingly, the back pressure applied to the rear surface of the swivel scroll 400 is maintained constant by the first and second sealing members 911 and 912 and lowering of the efficiency of the compressor is prevented by sealing the back pressure chamber BAC.

Also, the magnitude of the back pressure force can be regulated according to the size of the inner peripheral surfaces of the first sealing member 911 and the second sealing member 912.

That is, as shown in FIG. 4, since an area (inner peripheral surface) to which the pressure of the refrigerant is regulated, the magnitude of the back pressure force can be regulated.

In more detail, since the first sealing member 911 has an inner diameter different from that of the second sealing member 912, a reactive force applied from the first sealing member 911 is controlled by a difference between the inner diameters of the first sealing member 911 and the second sealing member 912, and the back pressure force is controlled by the reactive force from the first sealing member 911.

While the invention has been shown and described with reference to certain exemplary embodiments thereof, it will be understood by those skilled in the art that various changes in form and details may be made therein without departing from the spirit and scope of the invention as defined by the appended claims.

INDUSTRIAL AVAILABILITY

According to the present invention, there is provided a scroll compressor with an improved back pressure force control function that prevent wear of a frictional portion between a swivel scroll and a main frame while minimizing the mass of the compressor by adding a thrust plate of high hardness to the frictional portion and prevents lowering of an efficiency of the compressor and damage to the compressor.

There is also provided a scroll compressor in which a back pressure force can be easily regulated by regulating the area of the sealing member.

There is also provided a scroll compressor that allows a space for mounting the sealing member to be easily secured to sufficiently maintain the sealing effect of a back pressure chamber and enhances the durability of the sealing member.

The invention claimed is:

1. A scroll compressor with an improved back pressure force control function that includes: a housing, a drive unit configured to generate a rotating force; and a scroll compression unit having a fixed scroll constituted by a spiral scroll wrap for compressing a suctioned fluid and fixed irrespective of a rotation of a drive shaft of the drive unit and a swivel scroll swiveled according to rotation of the drive shaft and having a spiral scroll wrap, the scroll compressor comprising:

a main frame disposed within the housing to support a rear surface of the swivel scroll and having a back pressure chamber in an interior thereof;

a thrust plate disposed between the swivel scroll and the main frame; and a sealing member inserted between the swivel scroll and the main frame, wherein the sealing member includes a first sealing member inserted between the swivel scroll and the thrust plate, and a second sealing member inserted between the thrust plate and the main frame wherein, the first sealing member has an inner diameter different from that of the second sealing member, a reactive force applied from the first sealing member is controlled by a difference between the inner diameters of the first sealing member and the second sealing member, and the back pressure force is controlled by the reactive force from the first sealing member.

2. The scroll compressor as claimed in claim 1, wherein the swivel scroll and the main frame are made of aluminum, and the thrust plate is made of a steel-based metal.

3. The scroll compressor as claimed in claim 2, wherein the thrust plate is thermally treated or surface-treated.

4. The scroll compressor as claimed in claim 1, wherein the thrust plate is thermally treated or surface treated.

5. The scroll compressor as claimed in claim 1, wherein a receiving recess into which the thrust plate is inserted is formed in the main frame.

6. The scroll compressor as claimed in claim 1, wherein an outer diameter of the thrust plate is larger than a swivel diameter of the swivel scroll.

* * * * *